United States Patent [19]

Weir

[11] 4,416,097

[45] Nov. 22, 1983

[54] UNIVERSAL BEAM CONSTRUCTION SYSTEM

[76] Inventor: Richard L. Weir, 2217 Grant Ave., Dayton, Ohio 45406

[21] Appl. No.: 851,965

[22] Filed: Nov. 16, 1977

Related U.S. Application Data

[63] Continuation of Ser. No. 659,836, Feb. 20, 1976, abandoned.

[51] Int. Cl.[3] ..... E04F 17/08; E04C 1/10; E04C 1/04

[52] U.S. Cl. ..... 52/220; 52/221; 52/236.7; 52/262; 52/270; 52/293; 52/575; 52/586; 52/594; 52/731

[58] Field of Search ..... 52/90, 91, 220, 221, 52/227, 262, 284, 574, 594, 586, 606, 731, 236.7, 270, 293, 575

[56] References Cited

U.S. PATENT DOCUMENTS

| | | | |
|---|---|---|---|
| 211,291 | 1/1879 | Beach | 52/731 |
| 902,204 | 10/1908 | Brown | 52/574 X |
| 1,070,572 | 8/1913 | Wyckoff | 52/594 X |
| 1,295,919 | 3/1919 | Muhlhausen | 52/586 |
| 2,031,194 | 2/1936 | Thompson | 46/25 |
| 2,585,051 | 2/1952 | Simon | 52/262 X |
| 2,877,506 | 3/1959 | Almoslino | 52/574 X |
| 3,362,739 | 1/1968 | Staeger et al. | 52/586 |
| 3,452,498 | 7/1969 | Kinsey | 52/262 |
| 3,478,482 | 11/1969 | Weir | 52/594 |
| 3,547,472 | 12/1970 | Ehrman | 52/285 |
| 3,722,704 | 3/1973 | Piretti | 52/284 X |
| 3,906,665 | 9/1975 | Medlin | 52/594 X |
| 3,992,834 | 11/1976 | Valenzano | 52/594 X |

FOREIGN PATENT DOCUMENTS

| | | | |
|---|---|---|---|
| 2338208 | 2/1974 | Fed. Rep. of Germany | 52/586 |
| 929841 | 7/1947 | France | 52/574 |
| 935892 | 2/1948 | France | 52/248 |
| 453363 | 11/1949 | Italy | 52/731 |
| 2613 | of 1872 | United Kingdom | 52/574 |
| 184561 | 8/1922 | United Kingdom | 52/90 |

*Primary Examiner*—Alfred C. Perham
*Attorney, Agent, or Firm*—Jerome P. Bloom

[57] ABSTRACT

This application discloses a system of construction that uses as its main component, a flat panel member similar to a standard 2×8 timber with both edges beveled at a 45° angle in opposite directions with an interlocking female recess in one of the 45° sections and an interlocking male extrusion on the opposing 45° section. These components may be assembled to provide: (1) a straight narrow wall by reversing adjacent panels and sliding male extrusions and female recesses together, (2) assembly of two adjacent panels to form an angle by sliding male extrusion and female recess together without reversing the sections, (3) forming a U channel by sliding three sections together in a similar manner, (4) sliding four sections together in a similar manner to form a square, hollow beam section. For beam assembly purposes, identical matching female type grooves are provided in the outer face of the basic panel toward either edge of the outer face so that the beams, when assembled together, may be locked in alignment by double male splines which are inserted in the adjacent female grooves at assembly. Walls, floors, ceiling and roofs of a building as well as interior walls and drape walls, may thus be fabricated from a single component and the double male spline insert. Horizontal beam section will be used at header and footer levels of vertical wall sections for post stressing and chases for wiring harnesses and plumbing assemblies. Insulated thru wall ducting is provided throughout the structure.

9 Claims, 17 Drawing Figures

UNIVERSAL BEAM CONSTRUCTION SYSTEM

This particular application is a continuation of applicant's presently pending application Ser. No. 659,836, filed Feb. 20, 1976 for UNIVERSAL BEAM CONSTRUCTION SYSTEM now abandoned.

BACKGROUND OF THE INVENTION

This invention relates to a new and improved system and components for framing a housing or other building a basic and primary element of construction of which is an elongate, relatively flat, plate-like body having parallel outer faces one of which is wider than the other and oppositely sloping side edges, one of which sloping side edges has projecting means formed integral therewith and the other of which is recessed to accommodate said projecting means, the construction and arrangement of said side edges providing for a plurality of said elements to per se form a unitary structure by having recessed side edges thereof in abutting relation to side edges including said projecting means and having said projecting means lodge therein, thereby to provide within the limits of said plurality of elements a continuing wall surface.

There have been a number of proposals in a similar vein in the prior art, representative of which are the following U.S. Pat. Nos. 3,547,472; 3,362,739; 902,204. Also considered with reference to the prior art are U.S. Pat. Nos. 1,295,919; 2,585,051; 3,452,498; 3,478,482; 3,722,704; and foreign patents as follows: British Pat. Nos. 184,561 and 2,613 of 1872; French patent No. 929841; West German patent No. 2,338,208; and Italian patent No. 453363.

A review of the prior art clearly indicates that no one of the construction elements as heretofore proposed contemplates a single basic element of construction having the flexibility and extent of application and usage as a primary element per se of a frame structure for a room or building. The prior art devices directed to similar purposes cannot be variously and flexibly applied so as to avoid the use in conjunction therewith of separately applied attaching devices of various shape, arrangement and configuration.

It is to the simplification of the basic needs for construction and to an assembly of said basic needs to achieve a framing for a room or building that the efforts which resulted in the present invention were directed.

SUMMARY OF INVENTION

Various systems of interlocking block and beam construction, primarily for housing developments, have been devised and patented in the past. The principal problem with most of these systems has been the requirement for a large number of different units to complete a conventional building structure. The present invention is predicated on the use of a minimal number of different parts to provide a satisfactory family shelter with minimal skill requirements. The basic building element is a flat panel member similar to a standard 2×8 timber with both edges beveled at a 45° angle in opposite directions with an interlocking female recess in one of the 45° sections and an interlocking male extrusion on the opposing 45° section. These components may be assembled to provide: (1) a straight narrow wall by reversing adjacent panels and sliding male extrusions and female recesses together, (2) assembly of two adjacent panels to form an angle by sliding male extrusion and female recess together without reversing the sections, (3) forming a U-channel by sliding three sections together in a similar manner, and (4) sliding four sections together in a similar manner to form a square, hollow beam section.

For beam assembly purposes, identical matching female type grooves are provided in the outer face of the basic panel toward either edge on the outer face so that the beams, when assembled together, may be locked in alignment by double male splines which are inserted in the adjacent female grooves at assembly.

Walls, floors, ceiling and roofs of a building as well as interior walls and drape walls, may thus be fabricated from a single component and the double male spline insert.

Horizontal beam sections are used at header and footer levels of vertical wall sections and special threaded long bolts with internally threaded adapters on the ends are dropped thru bored holes in the header and footer beams and down thru the void in the vertical beams from the header to the footer at convenient intervals along the wall and screwed onto footer studs to post stress the wall sections and provide an integral sealed structure. Appropriate lubricating type adhesives can be used on the splines and male and female sections of the individual panels when assembled to assure sealed and structurally integral assemblies.

Appropriate modular openings are provided during assembly of the walls for the insertion of window and door assemblies.

The header and footer sections of the walls will provide for chases throughout the building. The header chase provides for the insertion of preassembled wiring harnesses and pressure plumbing manifolds which drop down to appropriate levels for fixture attachments. Power is supplied thru conventional means to the wiring harness and thru a common manifold to the individual lines for plumbing fixture attachments.

The plumbing waste system is comprised of a preassembled manifold that fits within preestablished plumbing wall voids. These voids are developed by proper assembly of the basic panels to provide the necessary space. As an alternate, threaded waste fittings may be assembled as the plumbing wall is laid up to provide for the waste system.

As the assembled construction system provides thru ducting in both horizontal and vertical directions, conventional air flow heat systems may be used. Electric heat or radiant heating may also be provided.

It is to be noted that the basic panels as proposed will be comprised of cellular cement with a plastic shell or other materials with similar characteristics, which will form a highly insulating unit and may be nailed or sawed for on-site modification as necessary.

In relation to the chase units for header and footer sections, it is to be noted that open areas may be provided in the top of the chase sections by splitting the fourth or top panel of the chase and installing sections with open spaces between, so that the necessary rigidity is maintained, but easy assessability to the inside of the chase is also possible for wiring, plumbing post stressing elements, and the like.

Although the panels which comprise the beams will be highly insulating, additional insulation may be provided by filling the voids in the walls with blown-in or poured-in insulation, such as cellulose or the like.

It is thus seen that an inexpensive, easily assembled building structure may be fabricated from one basic panel and a spline by unskilled labor. It is anticipated that individual beam sections, consisting basically of four panels assembled together, will be extruded in one operation when large production requirements are involved. The highly insulating characteristics of the proposed structure and the built-in voids (ducts) make structures fabricated from the beams particularly adaptable to the use of solar heat. It is also to be noted that beams may be sawed up into block size and used in the Modular Block construction system set forth in U.S. Pat. No. 3,478,482.

The system has been designed primarily for use by unskilled individuals, in that all of the necessary components for erection of a complete structure on a prepared slab is provided in package form that may be assembled by unskilled labor in a minimum period of time. The units are so designed that when assembled, they form straight, true walls and only simple instructions will be required for the insertion of window and door surrounds or pre-framed or pre-hung units. As wiring harnesses and plumbing manifolds will be preassembled, no special skills will be required for installation of these assemblies. Total structures may thus be fabricated by unskilled individuals that will provide adequate shelter in any part of the world. As the basic structural member and/or box beam extrusion will provide a finished exterior and interior surface at assembly, no additional finish will be required to provide a liveable structure.

As previously noted, the panels and/or beams are highly insulating and provide thru-wall ducting for heating or cooling.

The above noted and other objectives and advantages of the present invention will become apparent from consideration of the following drawings and description.

BRIEF DESCRIPTION OF THE DRAWINGS

Referring to FIG. 1, the basic interlocking panel 1, has a shell 2 that extends continuously around the periphery of the panel and may be interconnected with dividers 3 which separate the panel into multiple hollow chambers subsequently filled with structural and insulating light weight material 4. In cross section or front view, the panel is generally trapezoidal in shape on the exterior surface with 45° angles at both sides sloping upward toward the top which is parallel with the bottom as viewed in FIG. 1. On the left hand sloping side 5, a male extrusion 6 extends outwardly in the center of the sloped area. The outside of the male extrusion 6 is contoured at an acute angle 7 to slope surface 5 on both sides and has a flat top area. On the opposite sloped side 8, is a female recess 9 which is centered on the right hand slope 8. On both sides of the flat bottom area of recess 9 are acute angles 9A, matching the acute angles of male extrusion 6. The interior area of female recess 9 is contoured to receive the male extrusion 6 on the opposite side of FIG. 1. It will thus be seen that the male extrusion 6 will slide within an adjacent female recess 9 to form either a 90° angle, or by reversing the section, a flat structural assembly, FIG. 2. Toward both ends and equally spaced from each edge of the flat structural member 1 (FIG. 1) on the bottom or exterior side is an equal angular trapezoidal shaped slot 10 which is formed with the narrow portion of the equal angular trapezoidal opening in a downward position to accept one-half of a matching dual trapezoidal spline FIG. 6 described herein after. These splines are inserted when two matching beams or panel sections are joined to provide continuous locking and sealing between adjacent beams or panels. It is to be noted that by adding one additional member to the construction system, a basic interlocking panel as described above, but without the exterior trapezoidal shaped slots 10, and using these units for the inside and outside faces of the beams as erected, flat inner and outer walls without slots may be obtained.

Figure 2:
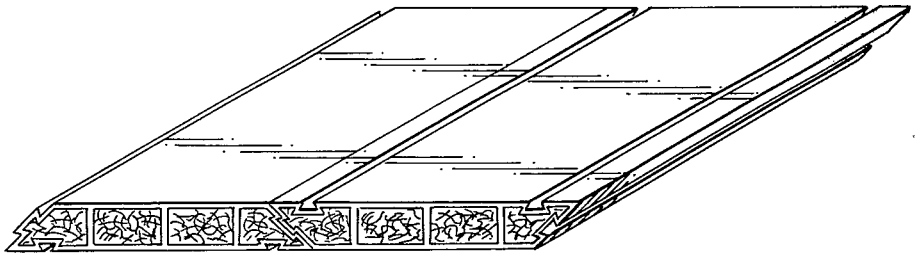
FIG. 2 is an isometric perspective view of two or more panels assembled to form a thin narrow wall.

In reference to FIG. 2, this assembly is formed by alternately reversing basic interlocking panels 1 and sliding interlock male and female elements together to form a flat plate structure assembly.

Figure 3:
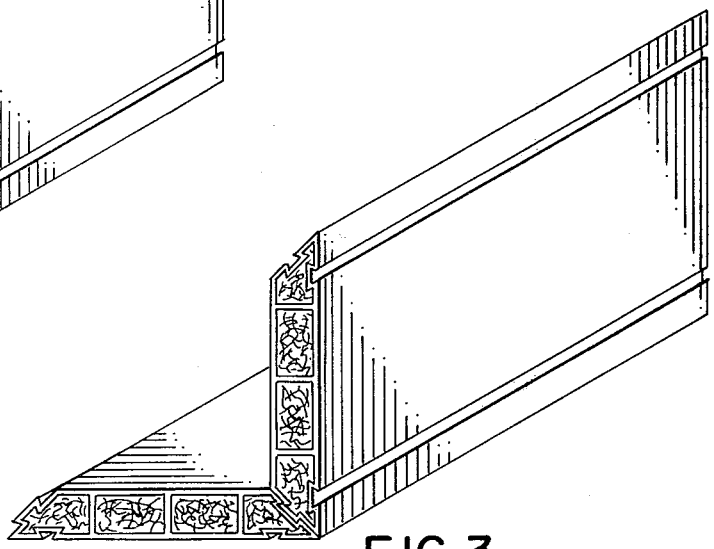
FIG. 3 is an isometric perspective view of an assembly of two panels to form an angular structural element.
Figure 1:
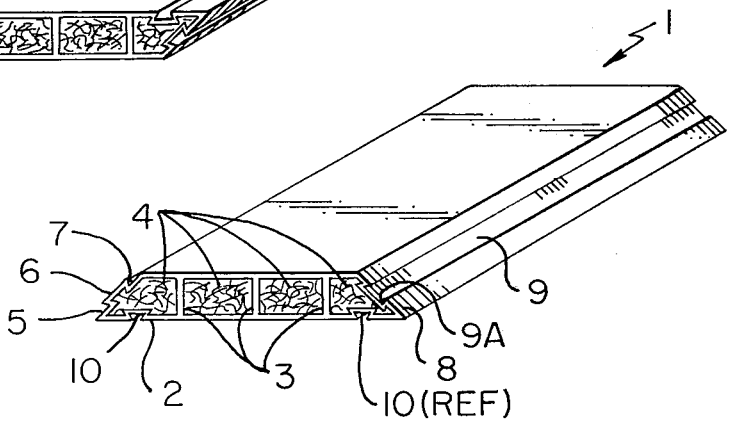
FIG. 1 is an isometric perspective view of the basic panel of the construction system.

In relation to FIG. 3, an angle is formed by sliding two basic interlocking panels 1 together at right angles to each other in the position shown in FIG. 1.

Figure 4:
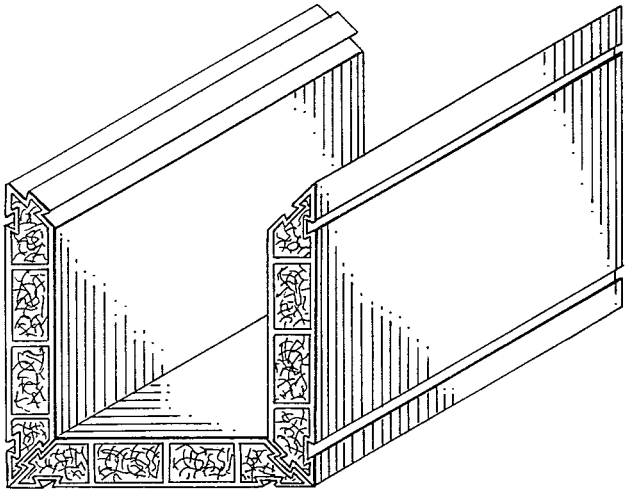
FIG. 4 is an isometric perspective view of an assembly of three panels to form a U-channel structural element.

The U-channel shown in FIG. 4 is comprised of three basic interlocking panels 1 interlocked together with the side panels at right angles to the base section 1, as shown.

Figure 5:
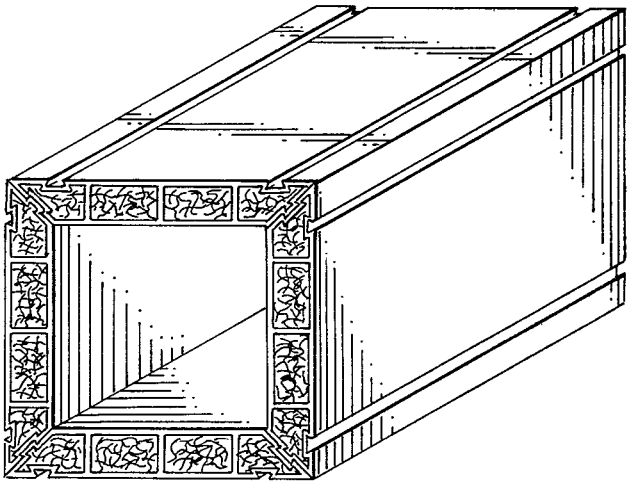
FIG. 5 is an isometric perspective view of four sections assembled together to form a hollow or box beam structural element.

With reference to FIG. 5, the box beam depicted herein is comprised of four basic interlocking panels 1 joined together by interlocks as described herein before.

Figure 7:
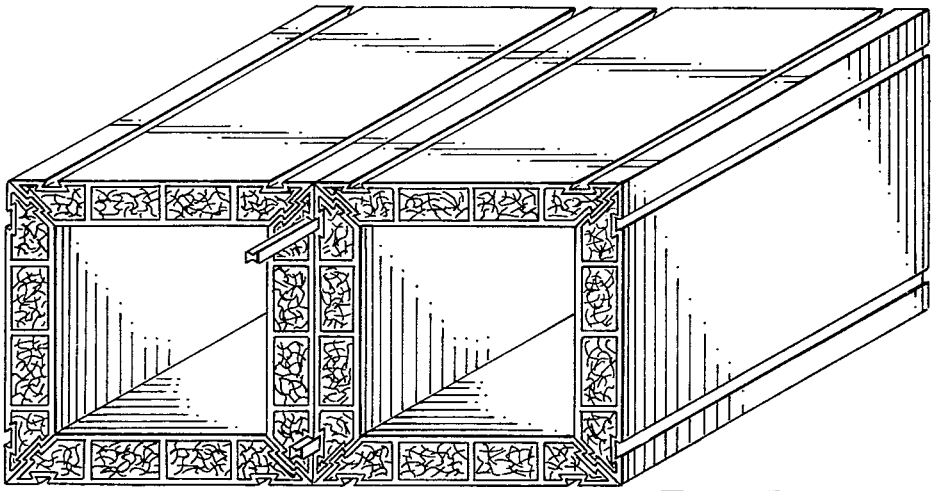
FIG. 7 is an isometric perspective view of two box beams joined together by splines.
Figure 6:
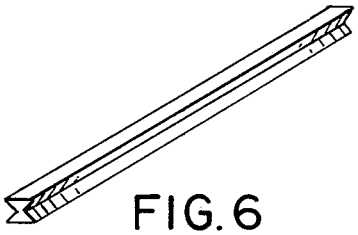
FIG. 6 is an isometric perspective view of a double spline interlock.
Figure 12:
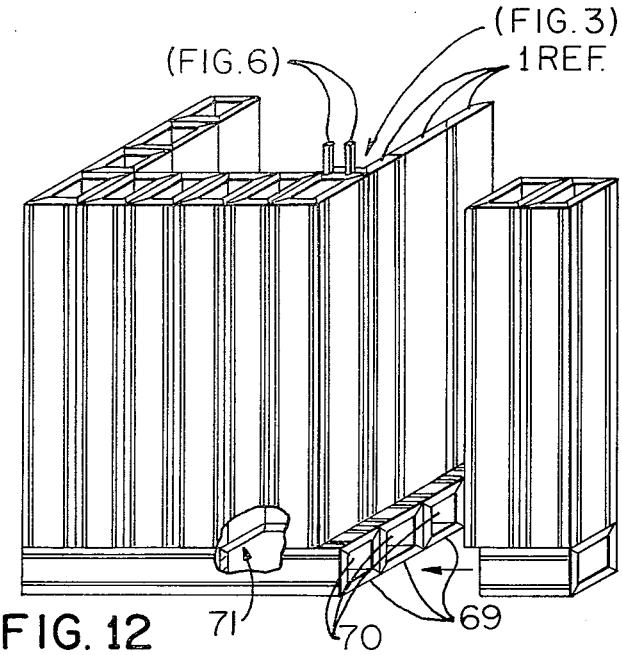
FIG. 12 is an isometric exploded view of an outer and inner wall assembly and floor ducting.

FIG. 6 depicts the spline interlock for joining flat panels or beam sections in locked and sealed positions and consists of two equal angular trapezoidal sections in an integral unit which forms a locking spline slideable within the exterior side (lower side, FIG. 1) female slots 10 of adjoining panels (FIGS. 7 & 12 described herein after).

FIG. 7 depicts two box beams of FIG. 5, joined by splines (FIG. 6). Any number of units may be joined in a similar manner to form a wall, floor, roof, ceiling section, or dividing wall (FIG. 12). It is to be noted that splines joining horizontal and vertical beam assemblies are not indicated throughout the drawings to eliminate complexity; however, the basic drawing, FIG. 7, depicts the installation that is common throughout the building when basic interlocking panels (FIG. 1) abut each other.

Figure 8A:
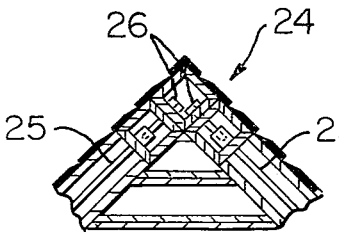
FIG. 8A is a cross sectional view of a typical roof peak assembly.
Figure 8:
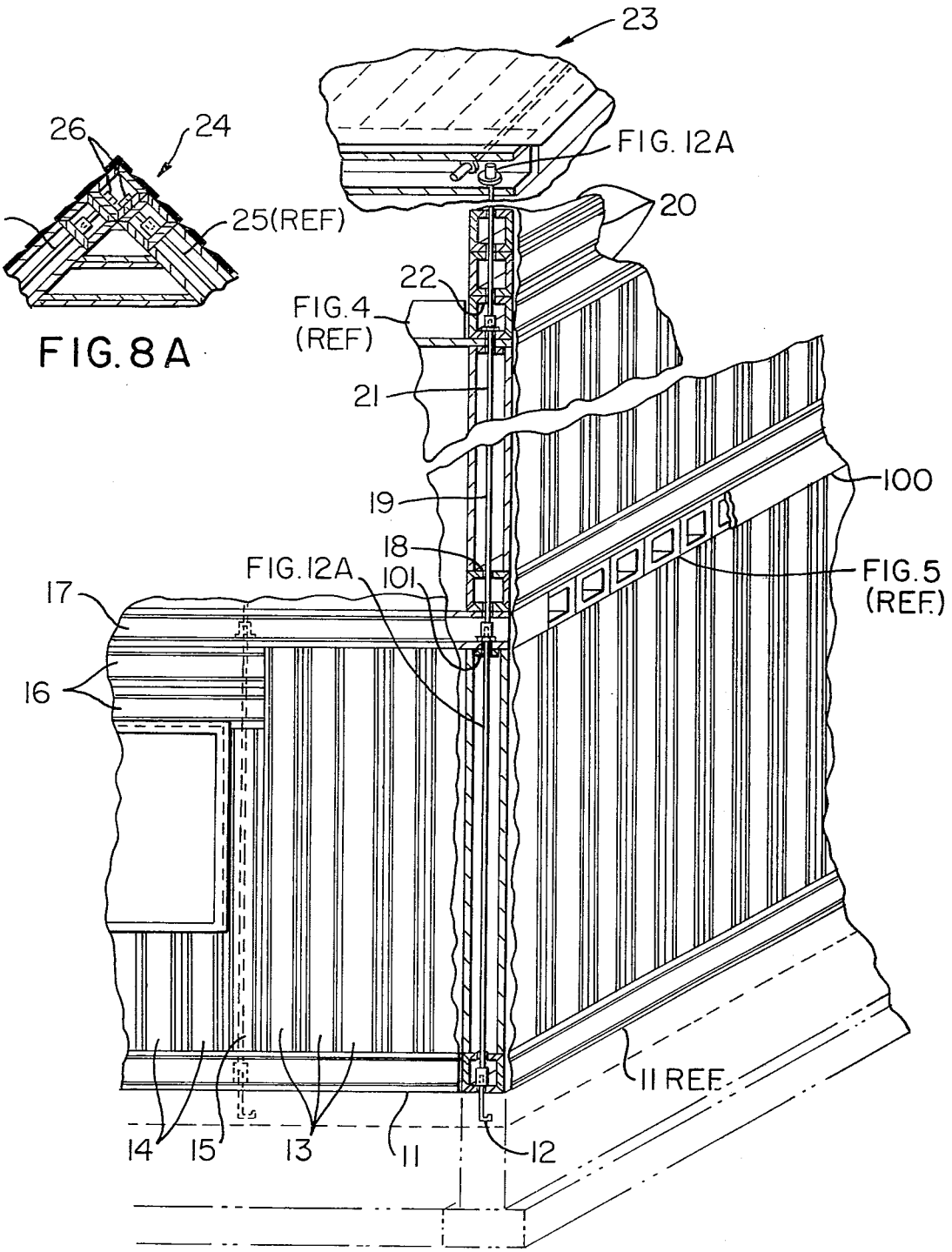
FIG. 8 is an isometric perspective view of a building wall and corner section showing header and footer sections and sloped roof attachment.
Figure 12A:
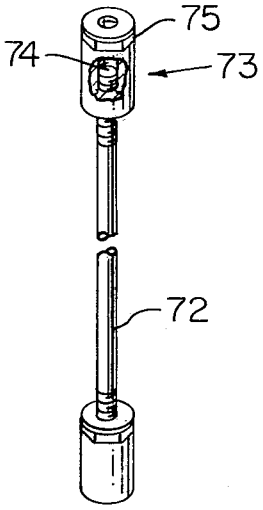
FIG. 12A is a pictorial view of a threaded rod and internally threaded sleeve/nut assembly.

FIG. 8 depicts the assembly of box beam sections to form the wall assemblies, floors, roof and ceiling of an assembled building. In FIG. 8, footer beams 11 are located in position over concrete embedded construction bolts 12, to form the basic perimeter of the building. Vertical beams 13 are then assembled together by splines inserted in adjacent female recesses 10 in adjoining beams to form wall panel assemblies. Shorter beam sections 14 are inserted under window openings in appropriate positions and likewise attached to adjoining beams by splines. At the end of both sides of the window opening, beams 15, cut to the height of the window opening, are installed and a horizontal twin beam assembly 16 is positioned over the window opening. Header/floor beams 17 are positioned horizontally on top of the vertical wall sections 13 and horizontal twin beam assembly 16. Header/floor beams 17 are attached to horizontal twin beam assembly 16 by splines and attached to footers by thru bolt sleeve assemblies (FIG. 12A, described herein after). Second floor footer beams 18 are then installed on top of header/floor beams 17 and vertical wall beams 19 are installed around the periphery of the wall, leaving appropriate window and door openings as required to complete the second floor exterior wall assembly. U-shaped ceiling panel assemblies (FIG. 4) are then positioned on top of vertical wall panel assemblies 19. Horizontal gable beam assemblies 20 may consist of box beams (FIG. 5) assembled one on top of another cut to appropriate lengths and joined by splines to provide the end wall area between the second floor and roof. Thru bolt 21 is inserted prior to installation of the header panel 22 of the lower horizontal box beam of the gable wall assembly 20 to post stress the vertical wall section to this point. Sloped roof assembly 23 may be built up of units of vertical and horizontal box beams, as described for wall assemblies and attached to wall assemblies by thru bolt and sleeve assemblies (FIG. 12A) or a standard truss-type roof system may be installed by conventional means. A band board 100 of plastic or other decorative material may be added to block open ends of floor beams (FIG. 5). Space blocks 101, which consist of square blocks with holes in the center to allow for the passage of rod and sleeve assemblies (FIG. 12) and center same, and which fit snugly within vertical wall beams, may be added to assure alignment of wall assemblies with header and footer beams.

FIG. 8A depicts a roof peak assembly above a gable end as described herein before. Roof ridge beam 24 has holes appropriately drilled for acceptance of thru bolt assemblies 25 and is assembled with lower basic interlocking panels (FIG. 3) assembled prior to installation of upper basic interlocking panels (FIG. 5) so that nuts 26 may be attached to the end of thru bolt assemblies 25 prior to assembly of two top basic interlocking panels 1. Some shimming will normally be required at pitches other than 45° between the sloped assemblies 23 and ridge beam 24.

Figure 9:
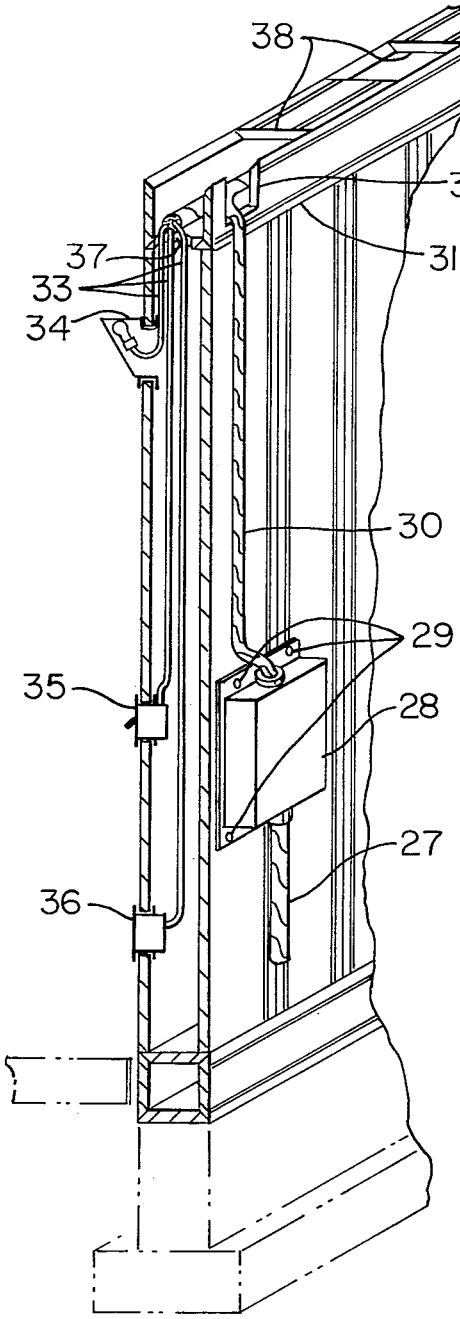
FIG. 9 is an isometric perspective and cross sectional view showing a wiring harness installed in a wall assembly.

FIG. 9 depicts the installation of electric wiring harness in the appropriate wall of a building. Service entrance cable 27 is attached to outside power service by conventional means. Fuse box 28 is attached to outside wall by commercial standard expansion bolts 29. Wiring harness main distribution line 30 extends upward along the wall and into chase beam 31 thru cut-out 32. The main distribution line 30 follows interconnected channel beam segments around the top of the wall as necessary to meet wiring requirements. Individual electric wires 33 with fixtures 34, 35, 36, attached with predetermined lengths of wire are dropped thru holes 37 bored as required in the chase base or thru holes provided by spaces left between the ends of lower chase basic interlocking panel 1. The prewired fixtures extend downwardly thru voids in the vertical wall beams and are fitted into appropriate openings in the wall. It is to be noted that the upper basic interlocking panel 38 may be cut in sections to leave spaces in the top or other side of the chase for insertion of wiring, plumbing, or other desired utilities.

Figure 10:
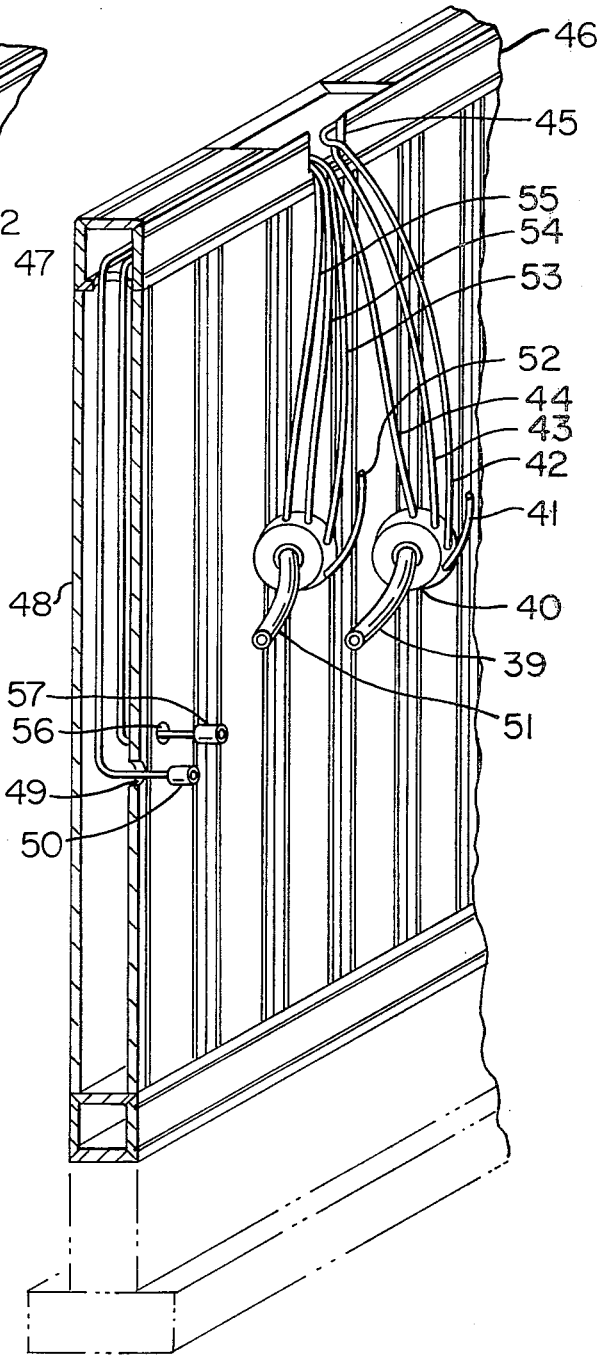
FIG. 10 is an isometric cross sectional view showing a pressure plumbing manifold installed in a wall assembly.

FIG. 10 depicts hot and cold pressure plumbing manifolds installed in a wall panel assembly. Hot water under pressure is supplied thru inlet line 39 from a commercial standard hot water heater. Within manifold 40, distribution is made to individual lines 41, 42, 43, 44 etc., as required. Individual lines extend upward thru cut out 45 and into header chase 46 and extend around the chase as necessary to an appropriate cut out 47 in the lower panel of the chase beam of the basic interlocking panel 1. The appropriate water line extends downwardly thru internal voids in vertical beam assemblies 48 to cut out 49, and inwardly thru the inner wall. An appropriate connector 50 is provided for attachment to the plumbing fixture. Similarly, a cold water manifold 51 is interconnected with lines 52, 53, 54, and 55 which likewise extends thru a cutout in the chase 45, thense within the chase 46 to appropriate cutout 47 and down thru a void in vertical wall beam 48 and out thru a hole in the wall 56. An appropriate connector 57 for attachment to the cold water side of the plumbing fixture is thus provided. Similar routings as necessary will be provided for lines 41, 42, 43, 44, 52, 53, 54, and 55.

Figure 11:
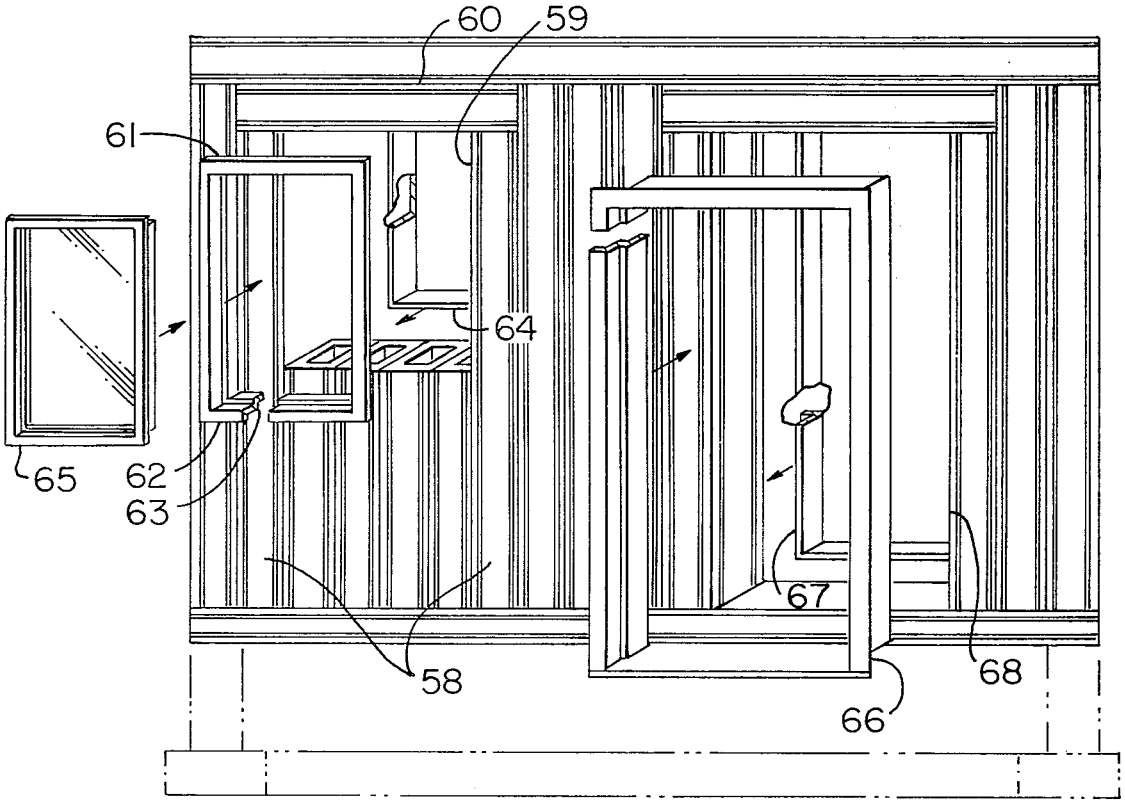
FIG. 11 is an exploded view showing a typical window or door installation in a wall assembly.

FIG. 11 is an exploded view of a vertical wall panel assembly depicting the installation of window and door frames within predetermined openings. Vertical beams 58 are provided at both sides of window opening 59 and allow for installation of a header beam 60 which extends over the window opening (twin header beams may be used, as in FIG. 8). External window surround 61 is sized to fit within the opening 59 and has external casing 62 and with right angle attached internal notched flange area 63 which completely surrounds the frame and is fabricated therein to provide for the insertion of the interframe unit 64 which fits within the notched area 63 as the internal casing 64 is inserted. The assembled frame is then attached by nailing, screwing, or other suitable means to the wall panel assembly. Glass retaining panel 65 is inserted in external casing 62. Preformed door frame casing 66 and inner casing 67 are likewise installed in a predetermined door opening 68.

FIG. 12 is an exploded isometric perspective view of a wall section with header beam omitted showing installation of thin inner room dividing wall, and beam floor installation and ducting. Basic interlocking structural panels 1 (FIG. 1) are attached in reversing sequence as described earlier herein. A U-shaped assembly (FIG. 3) is formed at the end of the wall panel and joined to the external wall by splines. A U-shaped header and end cap extrusion (not shown) may be used to finish off the top, bottom, and end of inner walls thus formed. The beam floor assembly 69 is comprised of a group of beams (FIG. 5) joined by splines as in wall assemblies. Void openings 70 provide thru-ducting for air passage when not filled with insulation material and may interconnect with voids in vertical beams at predetermined positions by openings in the top of the floor beams matching internal voids in the vertical beams as depicted in broken-out section 71.

FIG. 12A depicts a rod and sleeve assembly that is used throughout the structure. Rod 72 consists of a metal or plastic round rod cut to various lengths to meet specific requirements and threaded at both ends. Internally threaded sleeves 73 are cylindrical type elements with a centered round hole extending thru the center on which continuous threads 74 are formed. Toward one end of the cylinder, on the external face thereof, a hex face 75 is provided for wrench attachment. It will thus be seen that when rods are extended thru the wall openings and washers used in common fashion, walls may be attached to lower and upper beams and/or studs precast in footers, and wall assemblies post stressed to increase structural integrity of such assemblies. Roof assemblies may be attached to wall assemblies in a like manner.

Figure 13:
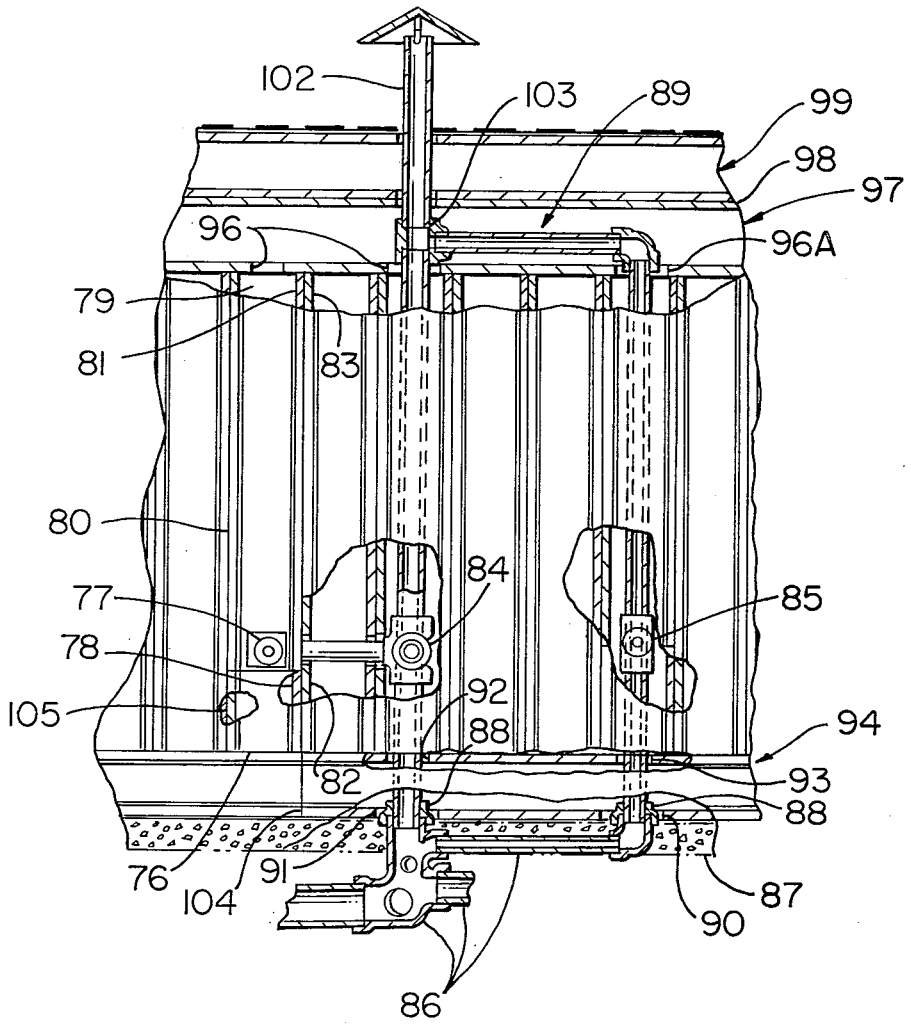
FIG. 13 is a cut away side view of a typical waste plumbing assembly installed in a plumbing wall.

FIG. 13 depicts a waste plumbing system installed in a plumbing wall. The concept depicted therein shows a unique capability of the construction system that may be applicable to any unit or assembly installed within or partially within a wall built with this system. To accomplish this purpose, the wall may be assembled in individual panels rather than in beam sections in the area in which the installation is to be made with individual panels separated and/or notched as necessary to allow for insertion of the required assembly and adjoining upward or horizontal units slid into place after installation of the required assembly to provide a continuous finished wall area around the assembly and around any protrusion extending thru the wall face. It is to be noted that if any two of the four panels of a box beam wall unit are continuous from header to footer, one or two of the other units may have partial or complete sections removed without materially effecting the structural integrity of the wall. If adjoining panels are cut to fit around protruding objects and ends cut to match adjoining ends when slid together, the wall appearance is not materially affected. Specifically with regard to FIG. 13, 86 depicts standard conventional plumbing waste system elements as installed within and under slab 87. Special adapters 88 are provided at the stack and vent waste openings at the slab level to provide for installation of a preassembled waste assembly 89. Holes 90, 91, 92 and 93 are provided in the top and bottom panel of base beam 94 to allow for insertion of the preassembled waste assembly 89. One side section of the base beam 94 is split at line 104 and left open for later insertion after special clamps 95 are attached connecting the waste assembly 89 to the under slab waste assembly 86. It is to be noted that all short lower wall sections below the waste system flanges extending into the bathroom must be inserted into the vertical wall panel assembly before the waste assembly 89 is set into place. Notched out areas 96 and 96A are provided in the lower panel of the header assembly for insertion of the system. This panel of the header assembly must be in place and the plumbing assembly 89 installed before the sides and top panels of the box beam header assembly 97 are inserted. Holes must be bored in the top panel 98 of box beam header assembly 97 and the roof box beam section 99 to allow for insertion of a stack extension 102 which will be screwed into an opening in the top flange 103 of plumbing wall assembly 89 described herein before. Prior to insertion of the plumbing assembly 89, a short section of the basic interlocking panel 76 is cut to the desired length to allow for protrusion of the external flange 77 of the plumbing waste system 89 and inserted in inner wall basic interlocking panel 105 at right angles thereto to form a wall face in the bathroom area. Inner wall panel 78 is likewise cut to allow passage for a plumbing system element within the wall. The vertical panel for the adjoining room panel 79, is inserted for the full length of the wall. Notched upper bathroom wall face panel 80 is then inserted in interlocking panels. Notched upper inner wall panel 81 is inserted in the assembly. A short lower abutting panel 82 is then spline-attached to panel 78 and upper inner wall panel 83 is spline-attached to upper inner wall 81. Assembly of the wall continues in a like manner to allow for the projection of external waste system flanges 84 and 85. Installations, other than waste plumbing manifolds, such as medicine cabinets, etc., may be likewise installed in wall sections. It will thus be seen that a complete finished plumbing wall structural assembly may be assembled with the basic interlocking panel and spline elements of the system.

Figure 14:
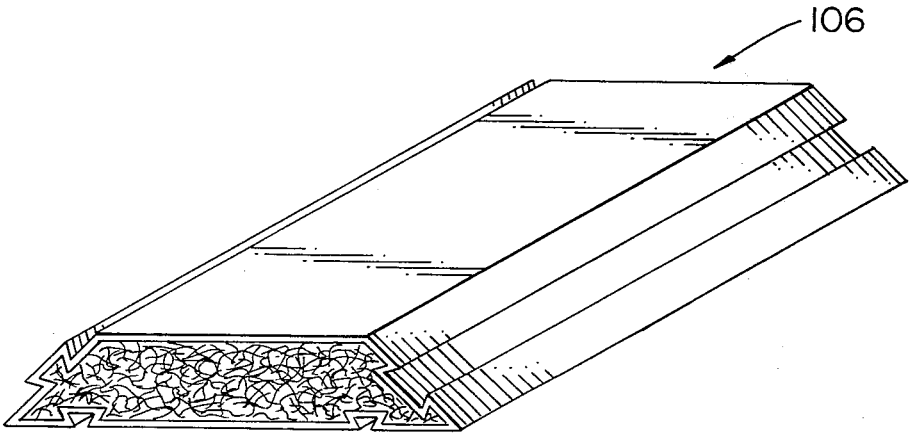
FIG. 14 is an isometric perspective view of a thin wall basic structural panel.

FIG. 14 depicts a narrow basic structural panel element 106 of the same basic configuration as that shown in FIG. 1, the exception being that one divider 3 and one of the central hollow chambers filled with structural and light weight insulating material 4 as shown in FIG. 1, is omitted making the panel less wide in the horizontal direction as shown in FIG. 14.

Figure 15:
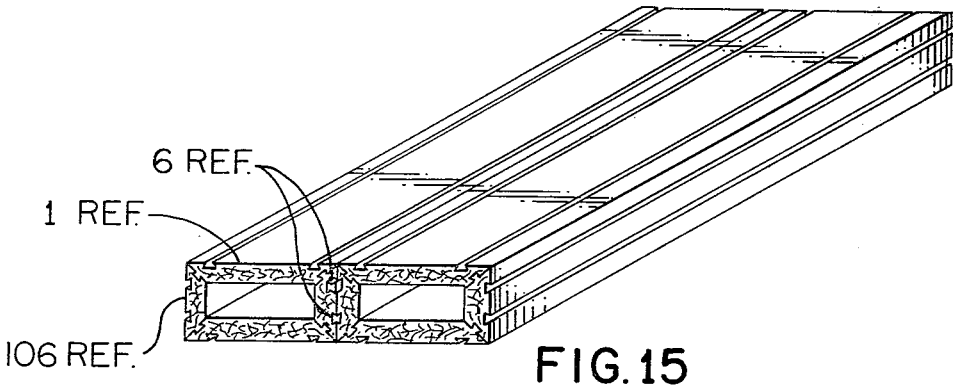
FIG. 15 is an isometric perspective view of a thin structural box beam assembly.

FIG. 15 depicts two rectangular box beam assemblies joined by splines. Each rectangular structural box beam is comprised of two narrow basic structural panels 106 positioned vertically and joined by male-female coupling elements with two standard basic interlocking panels 1, positioned horizontally; to provide a box beam construction assembly that will be less thick in an assembled wall, ceiling, roof or other structural assembly and thus save material when thinner walls are desired. It will thus be seen that by adding different width basic interlocking panels to the system, wall thickness may be varied as desired.

The construction description noted above delineates a method of constructing a complete housing structure with a finished surface inside and out from two basic elements, a specially formed basic interlocking panel and a spline. The spline grooves in the inner and outer wall faces may be eliminated by the addition of one more element of the construction system, a basic interlocking panel identical to that shown in FIG. 1 without the external spline grooves. These panels may then be used in the inner and outer wall faces when attaching means are not required for adjoining wall sections. Decorative effects may be achieved by special inserts in the splines' grooves.

The embodiments of the invention in which an exclusive property or privilege is claimed are defined as follows:

1. An element of construction which is reversible in application, comprising an elongate relatively flat, plate-like body having parallel outer faces one of which is wider than the other and oppositely sloping side edges, one of which sloping side edges has projecting means formed integral therewith and the other of which is recessed to accommodate like projecting means on a similar element, said side edges being constructed and arranged to provide that a plurality of said elements can be brought together in a side edge abutting relation to form a wall structure wherein adjacent elements may be co-planar or at right angles to each other or compositely arranged to form a structural beam, depending on the differential positioning of the adjacent elements in one sense or another enabled by their reversibility, at least one outer face of said element embodying therein means defining a recess providing that on placing a pair of said elements with faces thereof including said recess in abutting relation and with said recesses therein aligned, said recesses commonly accommodate a male configured connecting device to join said elements in their face abutted relation.

2. An element of construction which is reversible in application comprising an elongate relatively flat, plate-like body having parallel outer faces one of which is wider than the other and oppositely sloping side edges, one of which sloping side edges has projecting means formed integral therewith and the other of which is recessed to accommodate like projecting means of another said element, said side edges being constructed and arranged to provide that a plurality of said elements can be brought together in a side edge abutting relation to form a wall structure wherein adjacent elements may be co-planar or at right angles to each other or compositely arranged to form a structural beam, depending on the differential positioning of the adjacent elements in one sense or another enabled by their reversibility, a plurality of said elements being interfit in side by side following relation to form a continuing wall structure defining a beam, a further plurality of said elements being connected in side by side relation to form a further wall structure to frame a room area, and one or more of said beams serving as a structural member to which said further wall structure is tied.

3. An element of construction which is reversible in application comprising an elongate relatively flat, plate-like body having parallel outer faces one of which is wider than the other and oppositely sloping side edges, one of which sloping side edges has projecting means formed integral therewith and the other of which is recessed to accommodate a like projecting means, said side edges being constructed and arranged to provide that a plurality of said elements can be brought together in a side edge abutting relation to form a wall structure wherein adjacent elements may be co-planar or at right angles to each other or compositely arranged to form a structural beam, depending on the differential positioning of the adjacent elements in one sense or another enabled by their reversibility, a plurality of said elements being interfit in side by side following relation to form a continuing wall structure defining a beam, a further plurality of said elements being connected in side by side relation to form a further wall structure to frame a room area, one or more of said beams serving as a structural member to which said further wall structure is tied, a plurality of said beams being respectively placed at the head and foot levels of a wall structure defined by a plurality of said elements and said beams mounting an additional wall structure connected in generally spaced parallel relation to said first mentioned wall structure and similar thereto.

4. Apparatus as in claim 3 wherein at least a portion of said header or footer elements provide ducts for insertion therethrough of wiring, piping, conduits or the like.

5. Universal beam means in accordance with which a building or the like can be constructed using multiples of a single panel element per se to define planar wall forms and full or partial box beam forms, said single panel element incorporating configurations whereby one panel element may be brought to an assembled relation to another panel element by interengaging complementary configurations thereon, each panel element being reversibly interengageable with each other panel element to define therewith optionally a planar wall form or a part of a box beam, said single panel element being substantially trapezoidal in shape in cross section, side edges interconnecting opposite wall surfaces thereof at angles of approximately 45°, said side edges including said incorporated configurations and one of said opposite wall surfaces being additionally configured for the effecting of splined connections between adjacent beam forms.

6. Universal beam means according to claim 5, characterized by said incorporated configurations including in the instance of one side edge an extrusion perpendicular thereto and in the instance of the other side edge a recess perpendicular thereto, said extrusion and said recess having a complementary relation to one another and an extrusion of one panel element interfitting with a recess of a companion panel element in either of reverse positions thereof to define alternatively a planar wall form or a wall form the panel elements of which are at right angles to one another.

7. Universal beam means according to claim 6, wherein said one of said opposite surfaces has recesses constituting said additional configuration.

8. Universal beam means in accordance with which a building or the like can be constructed using multiples of a single panel element per se to define planar wall forms and full or partial box beam forms, said single panel element incorporating configurations whereby one panel element may be brought to an assembled relation to another panel element by interengaging complementary configurations thereon, each panel element being reversibly interengageable with each other panel element to define therewith optionally a planar wall form or a part of a box beam, a building or like structure being constructed by an application of single panel elements or sub-assembled beam forms to other said elements or other said beam forms preassembled to make beams useful in forming walls, headers, footers, gables and the like and as ducts for wiring, plumbing and like connections, and splines slidable in and between adjacent beam forms uniting said beam forms into a composite whole.

9. Universal beam means in accordance with which a building or the like can be constructed using multiples of a single panel element per se to define planar wall forms and full or partial box beam forms, said single panel element incorporating configurations whereby one panel element may be brought to an assembled relation to another panel element by interengaging complementary configurations thereon, each panel element being reversibly interengageable with each other panel element to define therewith optionally a planar wall form or a part of the box beam, said panel element being additionally configured so that one wall form or beam form can be joined to an adjacent form by interposing a spline in and between corresponding opposing additional configurations therein.

* * * * *